US007681750B2

(12) United States Patent
Jäckel

(10) Patent No.: US 7,681,750 B2
(45) Date of Patent: Mar. 23, 2010

(54) CLOSURE FOR A CONTAINER THAT HOLDS A FREE-FLOWING PRODUCT

(75) Inventor: Gerhard Franz Karl Jäckel, Freyung (DE)

(73) Assignee: Seaquist-Löffler Kunststoffwerk GmbH, Freyung (DE)

( * ) Notice: Subject to any disclaimer, the term of this patent is extended or adjusted under 35 U.S.C. 154(b) by 884 days.

(21) Appl. No.: 10/590,069

(22) PCT Filed: Mar. 4, 2005

(86) PCT No.: PCT/EP2005/002315

§ 371 (c)(1),
(2), (4) Date: Aug. 21, 2006

(87) PCT Pub. No.: WO2005/085085

PCT Pub. Date: Sep. 15, 2005

(65) Prior Publication Data

US 2007/0181523 A1 Aug. 9, 2007

(30) Foreign Application Priority Data

Mar. 5, 2004 (DE) ..... 10 2004 010 845

(51) Int. Cl.
*B65D 5/72* (2006.01)
*B65D 41/20* (2006.01)
*B65D 41/62* (2006.01)

(52) U.S. Cl. ..... 215/235; 215/310; 215/311; 220/203.17; 220/203.18; 220/203.29; 220/254.9; 220/367.1; 222/490

(58) Field of Classification Search ..... 215/235, 215/310, 311; 220/203.17, 203.18, 203.29, 220/281, 367.1, 254.9; 222/490, 631, 632, 222/634, 635, 636, 398, 402.1
See application file for complete search history.

(56) References Cited

U.S. PATENT DOCUMENTS 2,665,037 A * 1/1954 Zublin ..... 222/490
4,896,789 A * 1/1990 Federspiel ..... 220/203.17

(Continued)

FOREIGN PATENT DOCUMENTS

CH 275 750 A 6/1951
DE 44 17 569 A1 11/1995

OTHER PUBLICATIONS

German language Search Report forms PCT/ISA/210 and 220 for PCT/EP2005/002315.

(Continued)

*Primary Examiner*—Anthony Stashick
*Assistant Examiner*—Niki M Eloshway
(74) *Attorney, Agent, or Firm*—Wood, Phillips, Katz, Clark & Mortimer

(57) ABSTRACT

The invention relates to a closure for a container that holds a free-flowing product. The container is characterized by the following: a fixed lower part which can be fastened to a container neck that surrounds a container opening in order to seal said neck; a cover comprising a protruding connecting piece that forms a passage for the free-flowing product; a displaceable upper part which can be coaxially displaced on the lower part in and against the direction of the container between an outer resting position and an inner actuating position; a breaker or dish-shaped diaphragm valve which has a base consisting at least of a flexible elastic material and whose upper edge seals the underside of the upper part; perforations in the base of the diaphragm valve which are closed in the testing position of the upper part; and a diameter of the base that is greater than the inner cross section of the connecting piece. The outer end of the connecting piece continuously supports the base of the diaphragm valve, and the latter continuously pre-tensions the upper part in the direction of its resting position in such a way that, when axial pressure is exerted on the upper part in the direction of the container, the diaphragm valve is bent outwards, thus opening the perforations in the base.

18 Claims, 4 Drawing Sheets

U.S. PATENT DOCUMENTS

| | | | | | |
|---|---|---|---|---|---|
| 4,993,568 | A | * | 2/1991 | Morifuji et al. | 215/11.1 |
| 5,250,266 | A | * | 10/1993 | Kanner | 422/113 |
| 5,409,144 | A | * | 4/1995 | Brown | 222/185.1 |
| 5,769,253 | A | * | 6/1998 | Gross | 215/237 |
| 5,904,275 | A | | 5/1999 | Suffa | |
| 6,053,342 | A | * | 4/2000 | Chomik | 215/11.5 |
| 6,609,630 | B1 | * | 8/2003 | Freeman et al. | 220/714 |
| 6,708,714 | B1 | * | 3/2004 | Mijers | 137/102 |
| 6,910,607 | B2 | * | 6/2005 | Gaiser et al. | 222/490 |
| 7,077,296 | B2 | * | 7/2006 | Brown et al. | 222/185.1 |
| 2007/0210113 | A1 | * | 9/2007 | Genosar et al. | 222/207 |

OTHER PUBLICATIONS

German language Written Opinion fomr PCT/ISA/237 for PCT/EP2005/002315.

German language communication dated "Sep. 27, 2004" from the German Patent and Trademark Office.

International Preliminary Report On Patentability Forms PCT/IB/373 and PCT/ISA/237 for PCT/EP2005/002315 of which the instant application is a U.S. National Stage Patent Appliction.

* cited by examiner

CLOSURE FOR A CONTAINER THAT HOLDS A FREE-FLOWING PRODUCT

This application is an application filed under 35 U.S.C. Sec. 371 as a national stage of international application PCT/EP2005/002315, which was filed Mar. 4, 2005.

TECHNICAL FIELD

The invention pertains to a closure for a container that holds a free-flowing product as claimed in the preamble of claim 1.

BACKGROUND OF THE INVENTION AND TECHNICAL PROBLEMS POSED BY THE PRIOR ART

The preamble of claim 1 considers the state of the art known from DE 44 17 569 A1 which describes a closure for a container that holds a free-flowing product. This closure has a fixed lower part, which can be closely fastened to a container neck and a cover with an externally protruding connecting piece, whereby a displaceable upper part is coaxially displaceable on the lower part between an outer position and an inner position. Except during ventilation, the upper edge of a beaker-shaped diaphragm valve consisting of a flexible elastic material seals the underside of the upper part, and said valve has perforations in its base, which are closed in the resting position of the upper part, and continuously pretensions the upper part in the direction of its outer position. When pressure is exerted on the container, a side room of the closure can be filled with the pressurized product. As a result, the upper edge of the valve is sealingly pressed against the upper part and the valve is bent outwards by pressure onto its side walls through an extraction opening and is opened for the release of the product.

CH 275 750 describes a container with a device for delivery of limited amount of a fluid, wherein the device is provided with a closing means consisting of a elastic flexible material which comprises at least one through hole automatically closing due to the effect of elasticity. A pressure piece is provided for deforming the closing means for reducing the volume of the container und for being adapted to open the through hole for discharging fluid. The closing means is provided as a diaphragm, while the pressure piece is axially displaceable in front of the diaphragm so that by means of displacement of the pressure piece the diaphragm can be bent to the inside of the container. This, the through hole is opened and at the same time the volume of the inside of the container is reduced so that a certain amount of fluid is extruded to the through hole.

With closures for containers that hold a free-flowing product, the metering of the amount of the free-flowing product that is to be released in dependence on its viscosity is often difficult because the fine-tuning of the displaceable upper part of such a closure is often not only cumbersome and difficult to handle but also time-consuming. Furthermore, to fulfill the purpose of fine-tuning, the constructive effort for such closures is often economically disproportionate.

BRIEF SUMMARY OF THE INVENTION

The invention is thus based on the object of providing a closure that enables a very sensitive release of desired amounts of the free-flowing product held in the container with an extremely simple design of the closure.

The invention solves this object in that the diameter of the base of the diaphragm valve is dimensioned larger than the inner cross section of the connecting piece, the outer end of which continuously supports the base of the diaphragm valve so that, when axial pressure is exerted on the upper part in the direction of the container, the base of the diaphragm valve is bent outwards and the perforations in the base are opened.

According to the invention, the opening process of the diaphragm valve can be operated or controlled, respectively, in an extremely sensitive manner by actuating the upper part of the closure. The closure, in dependence on the type of container, with the solid or flexible wall being made from glass or plastic serving to squeeze the container content, can be used in an upside-down position as well as in a more or less upright position for releasing free-flowing products of very different viscosity. The upper part containing the release opening for the free-flowing product can be provided with a hinged lid for closing the outlet opening. If applicable, the hinged lid can also be connected with the upper part by means of a film hinge and form a single component therewith. Furthermore, it is also possible to use a protective cap for covering the upper part that is detachably applied on the lower part. Finally, a spring element that amplifies the pretensioning force of the diaphragm valve exerted on the upper part can additionally be used between the lower part and the upper part. Furthermore, as is customary, the closure can be screwed, chattered, or welded to the container, or can also be provided as a standard component of the container.

Further embodiments of the invention are contained in the subclaims.

BRIEF DESCRIPTION OF THE DRAWINGS

Below, the invention will be explained in more detail by means of the schematic drawing of exemplary embodiments, in which.

DETAILED DESCRIPTION OF THE INVENTION

Figure 1:
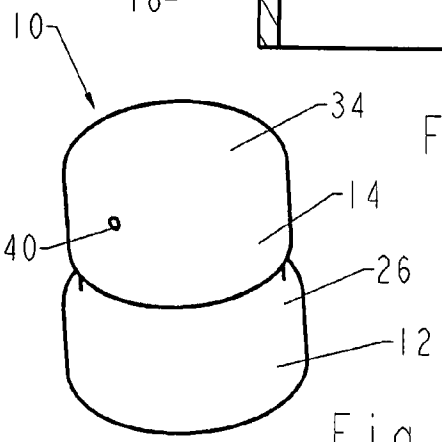
FIG. 1 shows a first embodiment of a closure in closed position in perspective view with a lateral release opening in the upper part.

FIG. 1 illustrates a closure 10 for a non-illustrated container that holds a free-flowing product, such as suntan lotions or oils, shaving creams or gels, sauces, ketchup, or the like. Customarily, the container has a neck provided with an outlet opening, whereby the closure at the outlet opening of the container can be fastened by screwing, chattering or welding. If necessary, container and closure can also be designed in a single piece. The container can consist of a solid material, such as glass or ceramic, or also of plastic, whereby the walls of a plastic container can be rigid or flexible. Preferably, it should be possible to empty the container in an upside-down position.

Figure 3:
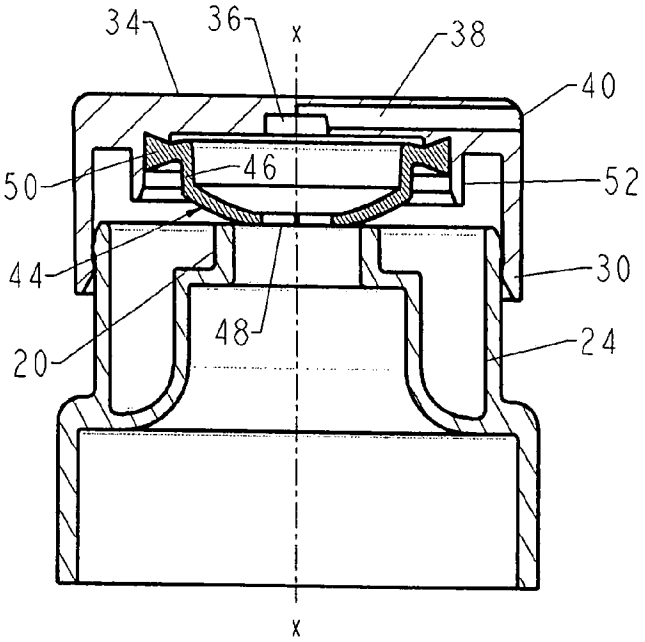
FIG. 3 shows a further center longitudinal view of the closure in FIG. 1, which is displaced by 90° in relation to the sectional illustration of FIG. 2.
Figure 2:
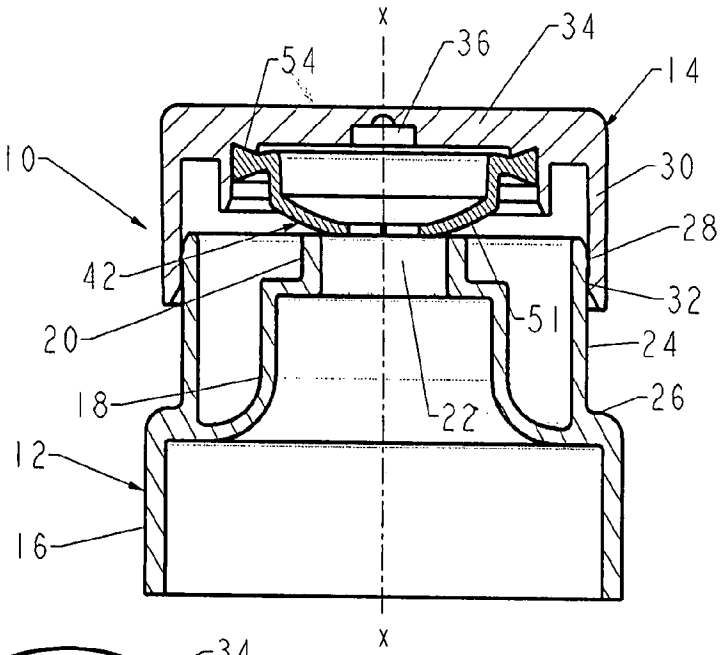
FIG. 2 shows a center longitudinal view of the closure of FIG. 1.

It can be seen from FIGS. 2 and 3, in particular, that the closure 10 consists of a fixed lower part 12 and a displaceable upper part 14, whereby the closure 10 is fastened to the outlet opening of the container with the lower part 12, as described. The lower part 12 has a cap shape with a rotary jacket 16, preferably being cylindrical or oval, but can also have other, angled forms, for example. The jacket 16 can be provided with an inside thread, which can be screwed onto an outer thread at the container neck, or arc-shaped or ring-shaped bosh bulges can be provided on the inner surface of the jacket 16 for chattering or overlapping, respectively, of corresponding protrusions at the container neck for attaching the closure on the container. Furthermore, the closure can also be welded or glued to the container or even produced in a single piece with the container, as is known from the prior art.

The lower part 12 is provided with a cover 18 having a connecting piece 20 that gradually conically tapers inwards and outwards that ends in a central passage 22 which is coaxial to the main axis x-x. A cylindrical guide piece 24 extends in a radial distance outside of the connecting piece 20, but, by forming a ring-shaped arresting shoulder 26, in a radial distance from the circumference of the jacket 16, to the height of the connecting piece 20 outwardly. At the outer end, the outside of the guide piece 24 is provided with at least one bulge-shaped protrusion 28 that extends on the same height in a ring-shaped or arc-shaped manner around the guide piece 24.

The upper part 14 is also cap-shaped and provided with a guide jacket 30 that overlaps the guide piece 24 on the outside and is coaxially guided thereon such that it can be moved to and fro. On its inner end, the inner peripheral surface of the guide jacket 30 is also provided with at least one bulge-shaped protrusion 32 that extends on the same height in a ring-shaped or arc-shaped manner via the inner peripheral surface of the guide jacket 30, but is arranged, as is shown in FIGS. 2 and 3, below the protrusion 28.

As can be seen from FIGS. 2 and 3, the at least one protrusion 28 of the lower part 12 and the at least one protrusion 32 of the upper part 14 form an arresting or locking device that determines the outer or upper resting position of the upper part 14. The arresting shoulder 26 of the lower part 12 limits the actuating lift of the upper part 14. Naturally, it is also possible, but less practical, to allow the guide jacket 30 of the upper part 14 to mesh with the guide piece 24 of the lower part 12 and to guide the same on its inner wall.

An end wall 34 of the upper part 14 extends vertically to the main axis x-x of the closure 10 and is provided with an inlet opening 36 for the free-flowing container content in the center of its underside. The inlet opening 36 ends in an outlet channel 38 (FIG. 3) that extends radially outwardly through the end wall 34 and ends in an outlet opening 40.

A preferably annular holder 52 for the diaphragm valve 42 protrudes from an inner side or underside 54 of the end wall 34 at a slight axial length and in a radial distance from the guide jacket 30.

A diaphragm valve 42 is arranged between the lower part 12 and the upper part 14 and has, as is shown in FIGS. 2 and 3, a beaker-shaped or dish-shaped part 44 with an approximately cylindrical outer wall 46, a base 48 being slightly arched towards the inside or downwards, as well as a flange-shaped, radially outwardly reinforced outer edge 50. The diaphragm valve 42 or at least its base 48, consist of a flexible elastic material, such as silicone, rubber or caoutchouc, or a plastic, such as polyethylene or a similar elastomeric material.

It can be seen from FIGS. 2 and 3 that the outside of the outer edge 50 of the diaphragm valve 42 sealingly abuts on the underside 54 of the end wall 34, as well as on the ring-shaped inner surface of the holder 52 with its radial outer surface. The diaphragm valve 42 is supported with its base 48 on the upper orifice of the connecting piece 20 and seals the connecting piece 20 in the closed position shown in FIGS. 2 and 3 and thus the container located therebelow, which is not illustrated in the drawings. The diaphragm valve 42 is axially clamped between the lower part 12 and the upper part 14 so that the displaceable upper part 14 is continuously pre-tensioned by the diaphragm valve 42 in the direction of its closed position shown in FIGS. 2 and 3 and fixed by the protrusions 28, 32. Consequently, the base 48 of the diaphragm valve 42 is also pressed onto the connecting piece 20 in terms of its secure sealing of the passage 22 of the connecting piece 20 in the closing position of the closure 10 by means of pretensioning.

Figure 7:
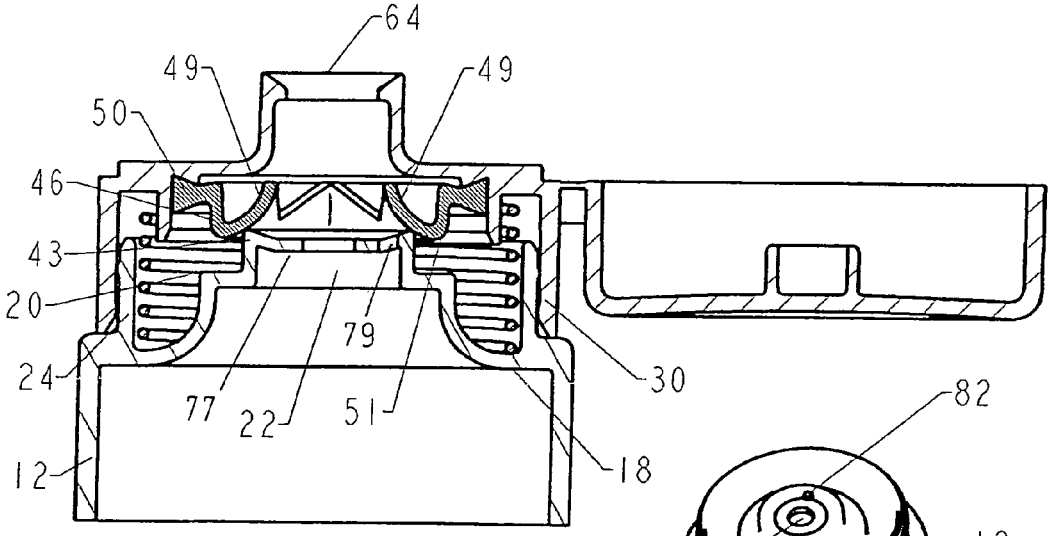
FIG. 7 shows the closure according to FIG. 6 in actuated open position.
Figure 8:
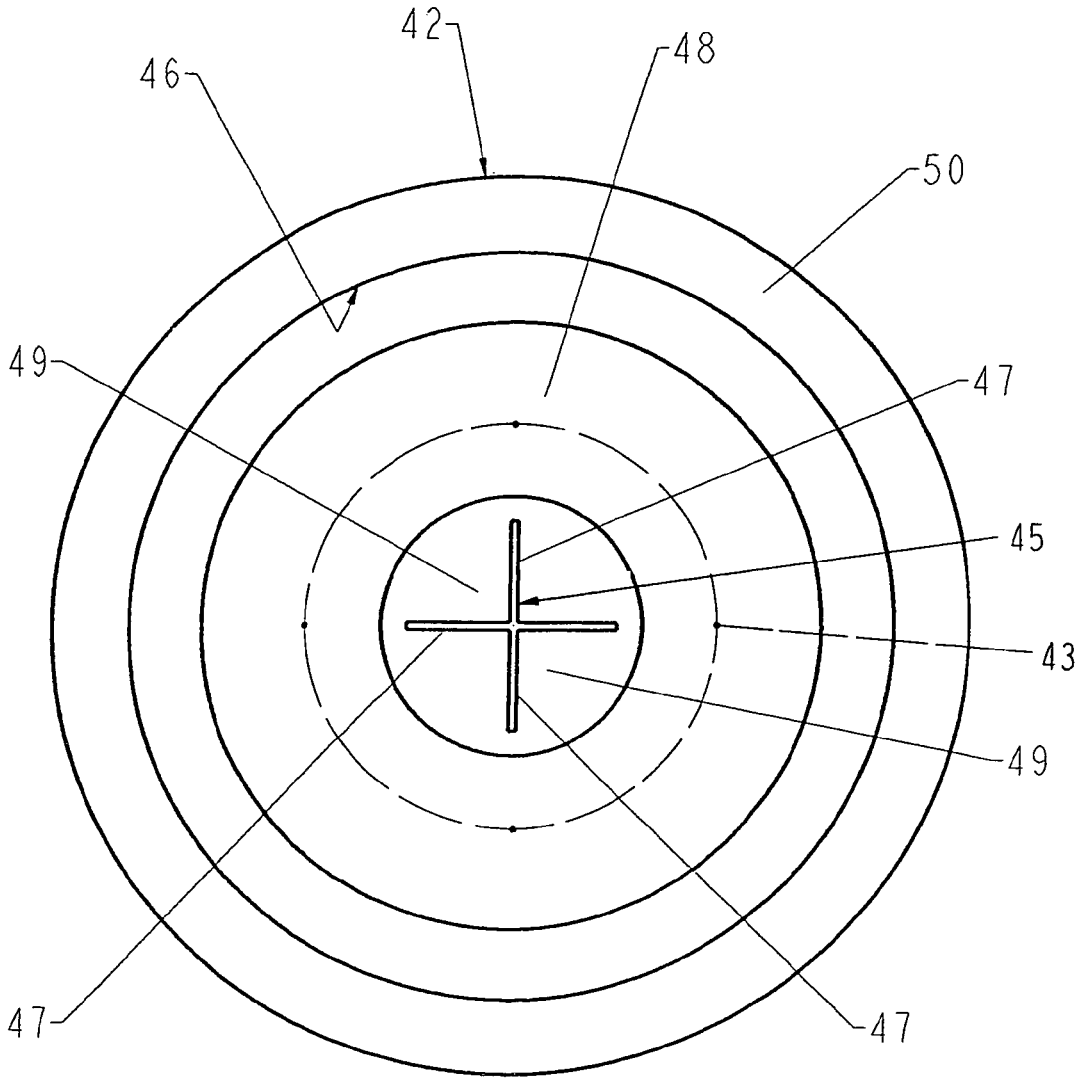
FIG. 8 shows a diaphragm valve in top view.

As can be seen from FIG. 7 and, in particular, from FIG. 8, the center of the base 48 is provided in radial distance from the ring-shaped contact line or surface with the upper front face 43 of the connecting piece 20 with at least one slit-shaped perforation 45 that is made so that it opens when the upper part 14 is moved by an operator in the opening direction, i.e., in the direction of the container or towards the inside or downwards, as will be described below in more detail. Preferably, the base 48 contains a plurality of slit-shaped perforations 45 that are arranged on a surface of the base 48 that is smaller than the inner cross section of the passage 22 of the connecting piece 20. FIG. 8 shows a plurality of slits 47 that extend in a star-shaped manner diametrically through the center of the base 48 at equal circumferential angular distances. The ends of the slits 47 are located at an appropriate radial distance from the circular front face 43 of the connecting piece 20 and thus have a smaller length, as compared to the inner cross section of the passage 22 of the connecting piece 20. The slits 47 thus limit triangular hinged covers 49 (FIGS. 7 and 8), the tip of which is located in the region of the center of the diaphragm base 48 and can bulge outwards or bend about their base in opening direction (FIG. 7).

As soon as a pressure is exerted by an operator onto the upper part 14 in the direction of the lower part 12, the compression force is transferred from the flange-shaped outer edge 50 of the diaphragm valve 42 via its cylindrical wall 46 to the outer edge 51 of the base 48 of the diaphragm valve 42 located outside of the front face of the connecting piece 20. Consequently, this outer edge 51 of the base 48 is pushed through the front face 43 of the connecting piece 20 onto its outside and beyond its front face 43 inwards or downwards and the base 48 is bulged outwardly via the passage 22 of the connecting piece 20 by stretching the flexible elastic material of at least the diaphragm base 48 so that the triangular hinged covers 49 formed by the slit-shaped perforations in the base 48 of the diaphragm valve 42 leave their closing position located approximately in the section of the base 48 and are bent outwards about their base and thus opened so that the free-flowing product can be released from the container in an amount determined by the opening measure of the diaphragm base 48. If the operator is resetting the upper part 14, the flexible elastic release capability of the diaphragm valve 42 is designed to be so large that it again assumes its beaker-shaped or dish-shaped form and thus lifts the upper part 12 in its outer or upper outlet or resting position. The base 48 thus returns into its closing position illustrated in FIGS. 2 and 3, whereby the hinged covers 49 again close in the section of the base 48 and seal the passage 22 of the connecting piece 20.

It can thus be seen that the diaphragm valve 42, in addition to the actual function as a valve, fulfills additional functions, i.e. the sealing of the interior of the container at the connecting piece 20 outwardly and as return spring, the constant exertion of a pretensioning force onto the displaceable upper part 14 in the direction of its upper defined resting position.

It is understood that, instead of or in combination with the slits 47 being arranged in a star-shaped manner, dot-shaped perforations can also be provided in the diaphragm valve 42, if necessary, as long as their ability is ensured to safely seal the passage 22 of the connecting piece 20 when the diaphragm valve 42 is closed and to sufficiently open the same when the upper part 12 is actuated.

Figure 5:
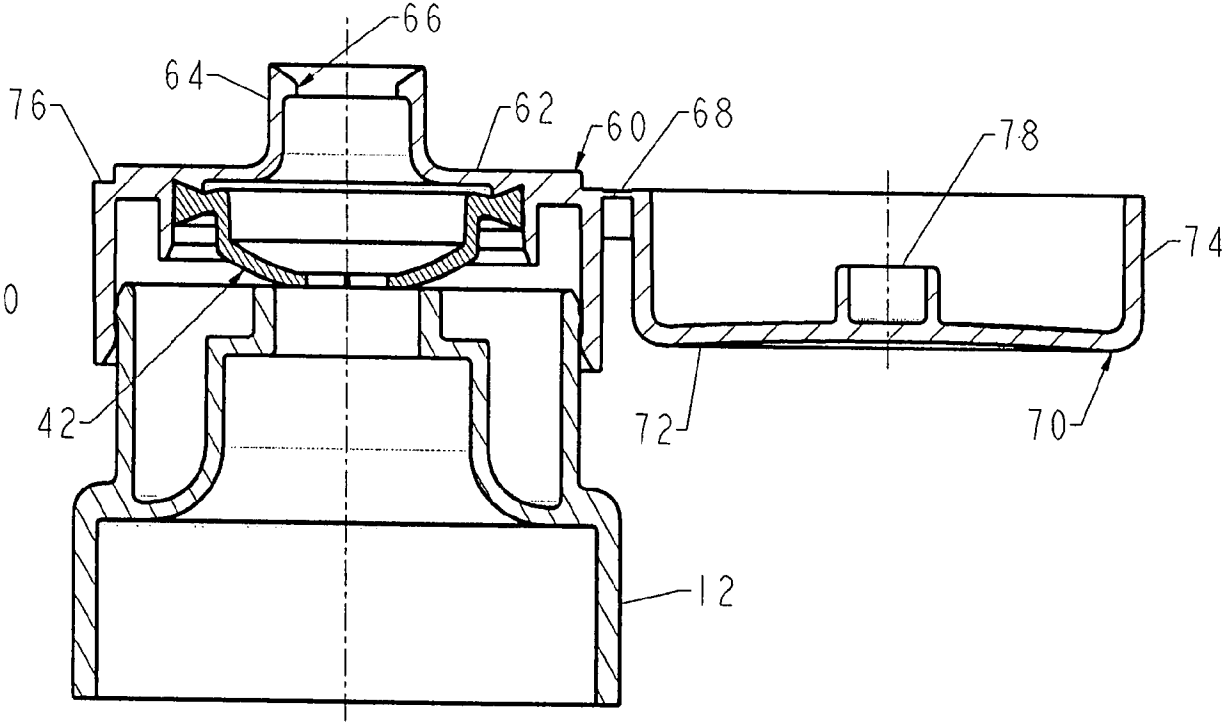
FIG. 5 shows a center longitudinal view of the closure of FIG. 4.
Figure 4:
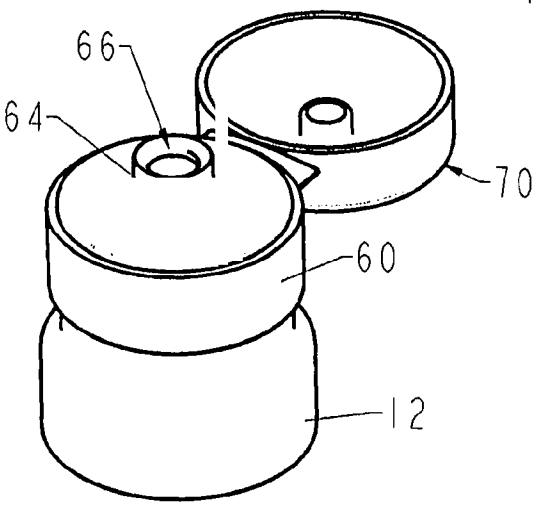
FIG. 4 shows a second embodiment of a closure with a modified upper part with an opened cover according to the invention in perspective illustration.

The second exemplary embodiment of the invention in FIGS. 4 and 5, where parts corresponding to the first embodiment are provided with the same reference numerals, differs from the first only in a modified form of an upper part 60, while the lower part 12 and the diaphragm valve 42 correspond to the first embodiment. FIGS. 4 and 5 show that the upper part 60 has an end wall 62 from which a central, outwardly facing, tube-shaped discharging piece 64 extends, which discharging piece 64 can also be used as drinking piece if the container content is a beverage. The discharging piece 64 is provided with a ring-shaped sealing bulge 66 at its upper inner end. At the level of the end wall 62, a hinged lid 70 is connected to the upper part 60 via a film hinge 68, whereby the film hinge 68 causes a dead center position. To overcome this dead center position during the opening and closing of the hinged lid 70, the film hinge 68 exerts an additional force onto the hinged lid 70 in closing direction or in opening direction, respectively. The hinged lid 70 has a head side 72, from the outer edge of which a jacket 74 extends that, when the hinged lid 70 is closed, engages into an external stepped shoulder surface 76 of the end wall 62 of the upper part 60 and aligns itself with its peripheral surface. A cylindrical sealing stopper 78, which sealingly engages with the discharging piece 64 when the hinged lid 70 is in its closed position, is arranged at the center of the inside of the hinged lid 70.

Figure 6:
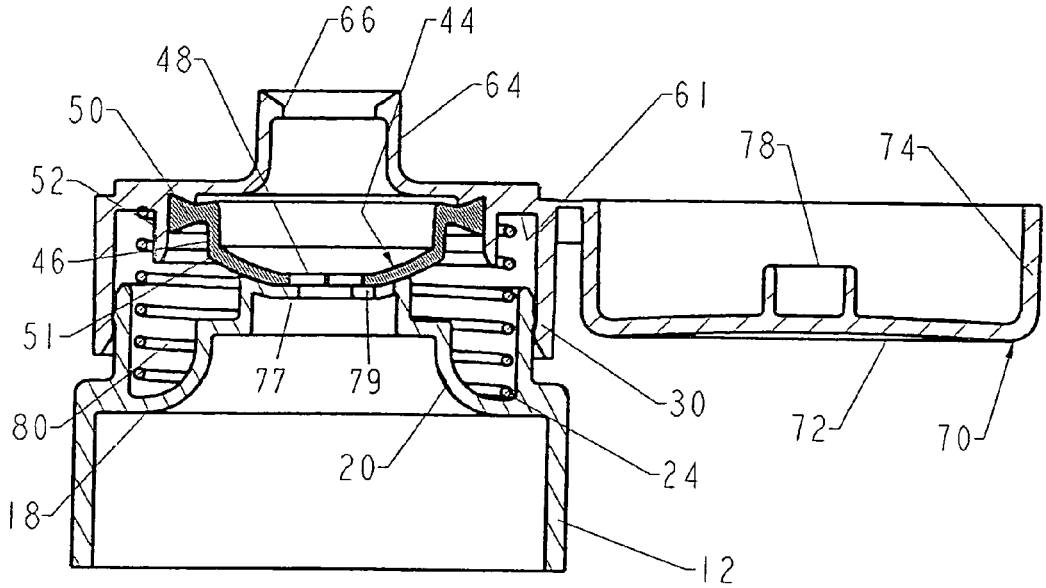
FIG. 6 shows the closure according to FIG. 5 with a spring element clamped between the lower part and the upper part.

FIGS. 6 and 7 show a third embodiment of a closure that is essentially identical with the closure according to FIGS. 4 and 5, with the exception that, additionally, a spring element 80 in the form of a helical compression spring amplifies the pretensioning force exerted onto the upper part 60 in opening direction. The upper end of the spring element 80 abuts on the inside or underside 61 of the end wall 62 of the upper part 60 between the outer periphery of the ring-shaped holder 52 and the inner periphery of the guide jacket 30. The lower end of the spring element 80 is supported on the cover 18 between the conical, stepped connecting piece 20 and the guide piece 24 of the lower part 12. The use of the spring element 80 is reasonable in cases where, for example for functional reasons, which, inter alia, can be ascribed to the consistency, such as the viscosity, of the free-flowing product, the diaphragm valve 42 cannot steadily exert that pretensioning or restoring force onto the upper part 60 that is necessary and desired for a reliable operation of the closure.

A further modification in the third embodiment of the closure according to the invention in FIGS. 6 and 7 pertains to the configuration of the passage 22 in the connecting piece 20. This is so, because the passage 22 is partly closed by a hole wall 77, which, where applicable, contains a plurality of holes 79 of different size and form. The hole wall 77 fulfills a support function for the base 48 of the diaphragm valve 42 in cases where, due to the fact that the diameter of the passage 22 of the connecting piece 20 is too large, for example, the closing function of the hinged covers 49 appears to desire additional safety measures.

In the top view onto the diaphragm valve 42 in FIG. 8, the outer wall 46 of the diaphragm base 48 and the outer front face 43 of the connecting piece 20 are illustrated in a dashed line to clarify the bending axis that is represented by the outer edge of the front face 43, when, during actuation of the upper part 14 of the closure 10 by the relatively stiff outer wall 46 of the diaphragm valve 42, the outer edge 51 is pushed inwards and a torque is exerted onto the bases of the hinged covers 49, in each case in the opening direction of the hinged covers 49.

Figure 9:
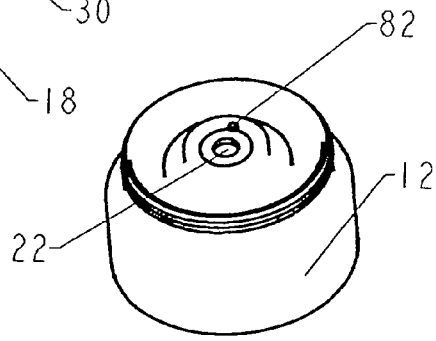
FIG. 9 shows an upper part of the closure with a ventilation opening in perspective top view.

In FIG. 9, the lower part 12 is shown in a perspective illustration in a partial top view so that a ventilation opening 82 can be seen that is arranged closely to the passage 22 and that enables a ventilation of the container during and after the release of free-flowing product. The size of the ventilation opening 82 is measured so that it allows air, but not the free-flowing product in the container to pass.

What is claimed is:

1. A closure for container that holds a free-flowing product with a fixed lower part (12), which can be closely fastened to a container neck and a cover (18) with an externally protruding connecting piece (20), whereby a displaceable upper part (14) is coaxially displaceable on the lower part (12) between an outer position and an inner position, a beaker-shaped diaphragm valve (42) consisting of a flexible elastic material, the upper edge (50) of which seals the underside (54) of the upper part (14), having perforations (45) in its base (48), which are closed in the resting position of the upper part (14), and continuously pretensions the upper part (14) in the direction of its outer position, characterized in that the diameter of the base (48) of the diaphragm valve (42) is dimensioned larger than the inner cross section of the connecting piece (20), the outer end of which continuously supports the base (48) of the diaphragm valve (42) so that, when axial pressure is exerted on the upper part (14) in the direction of the container, the base (48) of the diaphragm valve (42) is bent outwards and the perforations (45) of the base (48) are opened.

2. The closure as claimed in claim 1, characterized in that the diaphragm valve (42) is provided with a flange-shaped outer edge (50) that seals the inner side or underside (54) of the cover (18) as well as the inner wall of an inner, cylindrical holder (52) of the upper part (14).

3. The closure as claimed in claim 2, characterized in that a plurality of slits (47) are separated from one another by, preferably, equal circumference angles and form triangular hinged covers (49) that are elastically bendable about their wide base, each in the closing and opening direction.

4. The closure as claimed in claim 1, characterized in that the at least one perforation in the base (48) of the diaphragm valve (42) consists of a slit (47), the length of which is dimensioned smaller than the diameter of the passage (22) of the connecting piece (20).

5. The closure as claimed in claim 1, characterized in that the base (48) of the diaphragm valve (42) is punctured, whereby the punctures are closed in the closing state of the diaphragm valve (42), but are permeable for a free-flowing product in the actuated state, when the base (48) of the diaphragm valve (42) is bulged outwardly.

6. The closure as claimed in claim 1, characterized in that the upper part (14) is provided with a rotary guide jacket (30)

extending downwards from the end plate (34), with which the upper part (14) is axially displaceably guided on a guide piece (24) of the lower part (12).

7. The closure as claimed in claim 1, characterized in that cooperating guide and slide walls (24; 30) of the lower part (12) and of the upper part (14) are equipped with an arresting device that determines the resting position of the upper part (14).

8. The closure as claimed in claim 7, characterized in that the arresting device consists of at least one protrusion (28; 32) at the upper end of the outer peripheral surface of a guide piece (24) of the lower part (12) and at the lower end of the inner peripheral surface of a guide jacket (30) of the upper part (14).

9. The closure as claimed in claim 1, characterized in that between the lower part (12) and the upper part (14) a spring element (80) is provided, with which the upper part (14) is continuously pre-tensioned in the direction of its resting position.

10. The closure as claimed in claim 1, characterized in that the diaphragm valve (42) is made of silicone.

11. The closure as claimed in claim 1, characterized in that the diaphragm valve (42) is made of polyethylene.

12. The closure as claimed in claim 1, characterized in that the lower part (12) and the upper part (14) are made of plastic.

13. The closure as claimed in claim 12, characterized in that the lower part (12) and the upper part (14) are injection-molded from polypropylene.

14. The closure as claimed in claim 1, characterized in that the passage (22) of the connecting piece (20) is provided with a hole wall (77) as support for the base (48) of the diaphragm valve (42) in its closing position.

15. The closure as claimed in claim 14, characterized in that a hinged lid (70) is hinged to the upper part (60), the inside of which is provided with a sealing stopper (78) for the discharging piece (64).

16. The closure as claimed in claim 1, characterized in that a discharging piece (64) protrudes from an end wall (62) of the upper part (60).

17. The closure as claimed in claim 16, characterized in that the hinged lid (70) is connected with the upper part (14) in a single piece by means of a film hinge (68).

18. The closure as claimed in one claim 1, characterized in that the lower part (12) is provided with a ventilation opening (82) which is impermeable for the free-flowing product in the container in the region of its cover (18).

* * * * *

UNITED STATES PATENT AND TRADEMARK OFFICE

CERTIFICATE OF CORRECTION

PATENT NO. : 7,681,750 B2
APPLICATION NO. : 10/590069
DATED : March 23, 2010
INVENTOR(S) : Gerhard Franz Karl Jäckel It is certified that error appears in the above-identified patent and that said Letters Patent is hereby corrected as shown below:

Title Pg, Item (56) Other Publications: delete "fomr" and insert --form--;

Column 1, line 43, "und" should be --and--;

Column 1, line 48, "This" should be --Thus--; and

Column 8, line 20, "in one claim 1" should be --in claim 1--.

Signed and Sealed this

Eighteenth Day of May, 2010

David J. Kappos

David J. Kappos
*Director of the United States Patent and Trademark Office*